United States Patent [19]

Brewington et al.

[11] Patent Number: 4,990,958

[45] Date of Patent: Feb. 5, 1991

[54] RELOAD MEMBER FOR A SINGLE COMPONENT DEVELOPMENT HOUSING

[75] Inventors: Grace T. Brewington, Fairport; John M. Scharr, Farmington, both of N.Y.

[73] Assignee: Xerox Corporation, Stamford, Conn.

[21] Appl. No.: 456,399

[22] Filed: Dec. 26, 1989

[51] Int. Cl.[5] ..... G03G 15/06; G03G 21/00

[52] U.S. Cl. ..... 355/245; 118/661; 355/246

[58] Field of Search ..... 355/245, 246, 259, 261, 355/249; 118/654, 651, 661, 656, 653

[56] References Cited

U.S. PATENT DOCUMENTS

| | | | |
|---|---|---|---|
| 4,382,420 | 5/1983 | Ohnuma et al. | 118/651 |
| 4,408,862 | 10/1983 | Takano et al. | 118/656 X |
| 4,459,009 | 7/1984 | Hays et al. | 355/259 |
| 4,505,573 | 3/1985 | Brewington et al. | 355/259 |
| 4,641,602 | 2/1987 | Kasai | 118/653 |
| 4,774,541 | 9/1988 | Martin et al. | 118/653 X |
| 4,794,878 | 1/1989 | Connors et al. | 355/259 X |
| 4,868,600 | 9/1989 | Hays et al. | 118/653 X |
| 4,876,575 | 10/1989 | Hays | 118/653 X |

FOREIGN PATENT DOCUMENTS

| | | | |
|---|---|---|---|
| 0087471 | 5/1984 | Japan | 355/261 |
| 0114891 | 6/1985 | Japan | 355/259 |

*Primary Examiner*—A. T. Grimley
*Assistant Examiner*—Nestor R. Ramirez

[57] ABSTRACT

A single component development system utilizing insulative nonmagnetic toner. A toner mover transports toner from a supply of toner for transfer to a donor roll from which it is deposited on to latent electrostatic images contained on an imaging surface. An electrically biased flap of conductive material is supported for rubbing contact with the surface of the toner mover. Supporting the electrically biased, conductive flap in rubbing contact with the toner mover results in effective reloading of the doner roll notwithstanding the presence a high stress condition such as the requirement for developing images containing conditnuous solid areas.

5 Claims, 3 Drawing Sheets

RELOAD MEMBER FOR A SINGLE COMPONENT DEVELOPMENT HOUSING

BACKGROUND OF THE INVENTION

This invention relates generally to the rendering of latent electrostatic images visible and, more particularly, to a single component developer apparatus including a donor roll and an improved device for reloading the donor roll with toner.

The invention can be utilized in the art of xerography or in the printing arts. In the practice of conventional xerography, it is the general procedure to form electrostatic latent images on a xerographic surface by first uniformly charging a photoconductive insulating surface or photoreceptor. The photoreceptor comprises a charge retentive surface. The charge is selectively dissipated in accordance with a pattern of activating radiation corresponding to original images. The selective dissipation of the charge leaves a latent charge pattern on the imaging surface corresponding to the areas not struck by radiation.

This charge pattern is made visible by developing it with toner. The toner is generally a colored powder which adheres to the charge pattern by electrostatic attraction. The developed image is then fixed to the imaging surface or is transferred to a receiving substrate such as plain paper to which it is fixed by suitable fusing techniques.

The development of images by various methods, including electrostatographic means is well known. In some of these systems, toner particles are deposited on an electrostatic latent image contained on an insulating surface, such as selenium, utilizing, for example, cascade development, magnetic brush development, powder cloud development, touchdown development, and the like.

In view of some of the disadvantages of two component development systems, there has been considerable effort directed to designing single component development systems which utilize only toner particles, for example, U.S. Pat. No. 2,846,333, which discloses a single component developer composition that is comprised of toner resins, colorants and magnetic materials. Many of the single component development systems contain conductive toner particles, whereby imagewise toner deposition onto the imaging member is obtained by induction charging of the toner particles. Electrostatic transfer of conductive toner particles to plain bond paper is, however, usually inefficient as the charge on the toner particles can be reversed by induction charging from the paper during the transfer step. Accordingly, electrophotographic systems wherein conductive single component toner particles are used require an alternative transfer method and materials such as a special overcoated insulating paper to achieve sufficient toner transfer. Furthermore, in single component systems with conductive toner particles, the control of undesirable background or background suppression cannot usually be achieved with electrostatic forces alone, as the toner particles are inductively charged and deposited on the image bearing member in both the image and background areas, which is not the situation in two component developer systems where suppression of background development is accomplished by electrostatic forces acting on the triboelectrically charged toner particles, causing such particles to be directed away from image bearing member.

Recent developments in the area of single component development have resulted in an efficient, economical, simple process and apparatus wherein insulative, nonmagnetic, toner particles are appropriately charged and there is obtained two component image quality utilizing a single component development apparatus. In this system, as described in U.S. Pat. No. 4,505,573 issued on Mar. 19, 1985, the disclosure of which is incorporated herein by reference, a charging roll means simultaneously meters and charges toner particles. A donor electrode roll serves to transport the toner metered and charged particles from the charging roll to a charge retentive surface. The electrode can be comprised of numerous suitable materials including for example a conducting roll overcoated with a polymer containing carbon black.

Reloading of nonmagnetic single component development systems of prior devices is ineffective, particularly, in the case of developing continuous solid areas. Reload refers to the capability to restore the donor roll with toner in a single pass even under the stress condition of developing continuous solid areas. Adequate toner supply, flow and charging are requirements for reload.

In one prior art device, toner is transported down the length of a developer housing with a rotating toner mover which fluidizes toner in the developer sump. A DC bias (−1000 volts) between the toner mover and donor assists in loading right sign toner on the donor in the prenip region. Since the gap between the toner mover and donor is relatively large (0.06 inch), the applied electric field is low. Significant effort has been devoted to optimizing the toner mover design. Recent toner movers (holey tube, star, paddlewheel) show equivalent performance, but fall short of adequate reload. Typically with these toner movers, one observes reload defects such as loss of density or nonuniform density within the first three copies of a continuous solid area.

Certain patents which may be relevant to the present invention will now be discussed.

U.S. Pat. No. 4,382,420 issued on May 10, 1983 relates to an apparatus for developing a latent electrostatic image formed on a photoconductive recording material in a dry type electrophotographic copying machine typically employing a one component type developer with a conductive electrode held in contact with the developer. The electrode is connected to a power source through a switching device and serves to charge the developer to a predetermined polarity with a predetermined potential before the latent image is developed. In this way, the latent image can be developed selectively as either a normal image or a reverse image quite easily. FIG. 6 thereof discloses a charge and metering roller which regulates the layer of toner on a development belt and serves as an electrode as well.

U.S. Pat. No. 4,459,009 issued on Jul. 10, 1984 relates to a process and apparatus for charging insulating toner particles wherein there is provided a charging roll containing a triboelectrically active coating, and weakly charged toner particles are transported into contact with the coating contained on the charging roll, this contact being accomplished in a charging zone situated between the charging roll and the transporting mechanism. As a result of contact between the weakly charged toner particles and the triboelectrically active coating contained on the charging roll there is imparted charges of either a positive or negative polarity to the weakly charged toner particles. The apparatus and process of the present invention are useful, for example, in electrostatographic recording imaging devices.

U.S. Pat. No. 4,868,600 granted on Sep. 19, 1989 to Hays et al discloses a scavengeless development system in which toner detachment from a donor and the concomitant generation of a controlled powder cloud is obtained by AC electric fields supplied by self-spaced electrode structures positioned within the development nip. The electrode structure is placed in close proximity to the toned donor within the gap between the toned donor and image receiver, self-spacing being effected via the toner on the donor. Such spacing enables the creation of relatively large electrostatic fields without risk of air breakdown.

U.S. Pat. No. 4,876,575 granted on Oct. 24, 1989 to Dan A. Hays discloses a development apparatus including structure for the dynamic toner metering and charging of nonmagnetic single component toner. To this end there is provided a flexible, rotating rod having an electrical bias applied thereto. The rod is captured or supported by a distributed bearing attached to a compliant blade. A toner cleaning blade held against the rod serves as a toner seal. The flexible rod is supported in a self-spaced relationship to a rigid donor roll which transports the charged toner to a development zone intermediate the donor roll and an imaging member. Self-spacing is provided by a layer of toner on the donor structure. The donor roll and flexible rod form a toner metering and charging zone through which toner is moved to simultaneously charge and meter the toner particles. The roll and flexible rod are rotated in opposite directions for controlling the metering and charging of the toner in the nip U.S. patent application Ser. No. 07/428,726 filed Oct. 30, 1989 in the name of Brewington et al and assigned to the same assignee as the instant application discloses an apparatus which develops a latent image recorded on an image receiving member with developer material. A chamber in the developer housing stores a supply of developer material. A donor roll is positioned in the chamber of the housing so as to transport developer material into contact with the latent image to develop the latent image. A rotating, elongated member fluidizes the developer material. As developer material is discharged from a storage container into the chamber of the developer housing, it exerts pressure on the fluidized developer material to move the developer material from one end of the housing to the other end thereof. An electrical bias is applied between the elongated member and the donor roll so that developer material is attracted to the donor roll as the developer material advances from one end of the developer housing to the other end thereof.

BRIEF SUMMARY OF THE INVENTION

Briefly, the present invention uses a member in rubbing contact with an electrically biased toner mover. The member can be a flap of materials such as mylar, kapton, polyethylene, stainless steel sheet, or brushes of materials such as nylon, stainless steel, carbon fiber. Other reload member configurations include a rotating rod on the toner mover surface, a collection of beads which tumble on the toner mover surface or other compliant members for rubbing the surface of the toner mover.

The electrically biased toner mover and reload member are utilized in conjunction with an electrically biased donor roll and AC biased electrodes disposed between the donor roll and a charge retentive surface. Toner clouding is effected by the electrodes and an electrostatic field established between the charge retentive surface and the donor roll causes toner forming the toner cloud to be deposited on the charge retentive surface in image configuration.

DETAILED DESCRIPTION OF THE PREFERRED EMBODIMENT OF THE INVENTION

While the present invention can be utilized in conventional xerography and analogous printing arts it can also be utilized in highlight color imaging and will be disclosed in connection with such an imaging system and, in particular, it will be incorporated in a tri-level, highlight color imaging system.

Figure 1A:
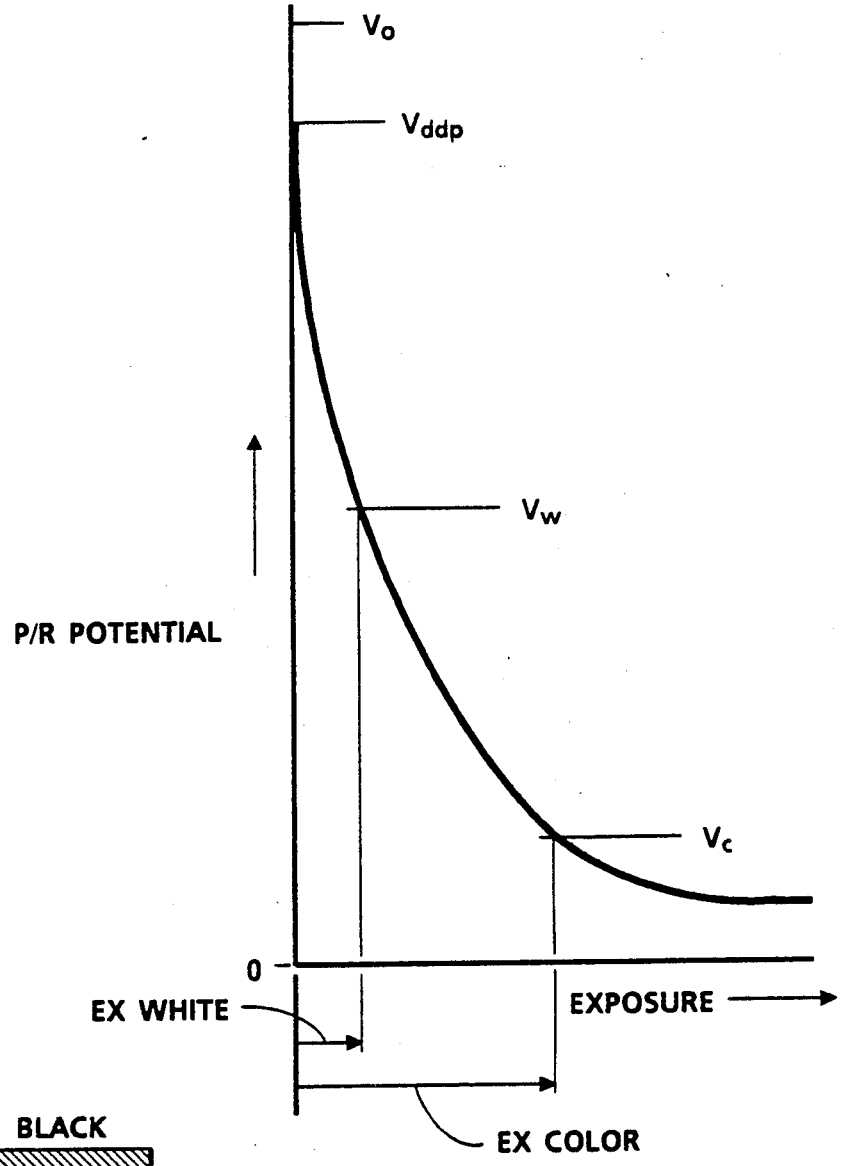
FIG. 1*a* is a plot of photoreceptor potential versus exposure illustrating a tri-level electrostatic latent image.
Figure 1B:
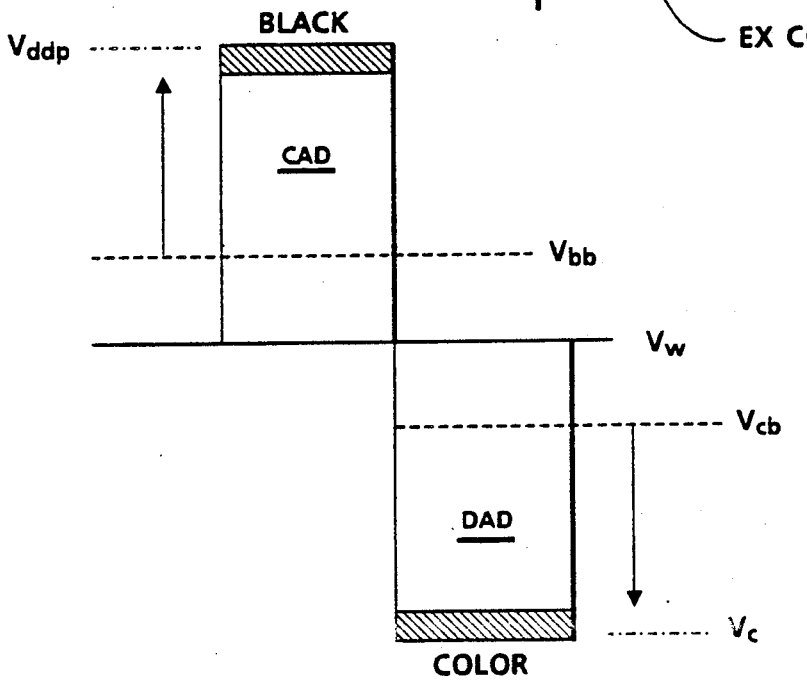
FIG. 1*b* is a plot of photoreceptor potential illustrating single pass, highlight color latent image characteristics.

For a better understanding of the concept of tri-level, highlight color imaging, a description thereof will now be made with reference to FIGS. 1*a* and 1*b*. FIG. 1*a* illustrates the tri-level electrostatic latent image in more detail. Here $V_0$ is the initial charge level, $V_{ddp}$ the dark discharge potential (unexposed), Vw the white discharge level and Vc the photoreceptor residual potential (full exposure).

Color discrimination in the development of the electrostatic latent image is achieved when passing the photoreceptor through two developer housings in tandem or in a single pass by electrically biasing the housings to voltages which are offset from the background voltage Vw, the direction of offset depending on the polarity or sign of toner in the housing. One housing (for the sake of illustration, the second) contains developer with black toner having triboelectric properties such that the toner is driven to the most highly charged ($V_{ddp}$) areas of the latent image by the electrostatic field between the photoreceptor and the development rolls biased at $V_{bb}$ (V black bias) as shown in FIG. 1*b*. Conversely, the triboelectric charge on the colored toner in the first housing is chosen so that the toner is urged towards parts of the latent image at residual potential, Vc by the electrostatic field existing between the photoreceptor and the development rolls in the first housing at bias voltage $V_{cb}$ (V color bias).

Figure 2:
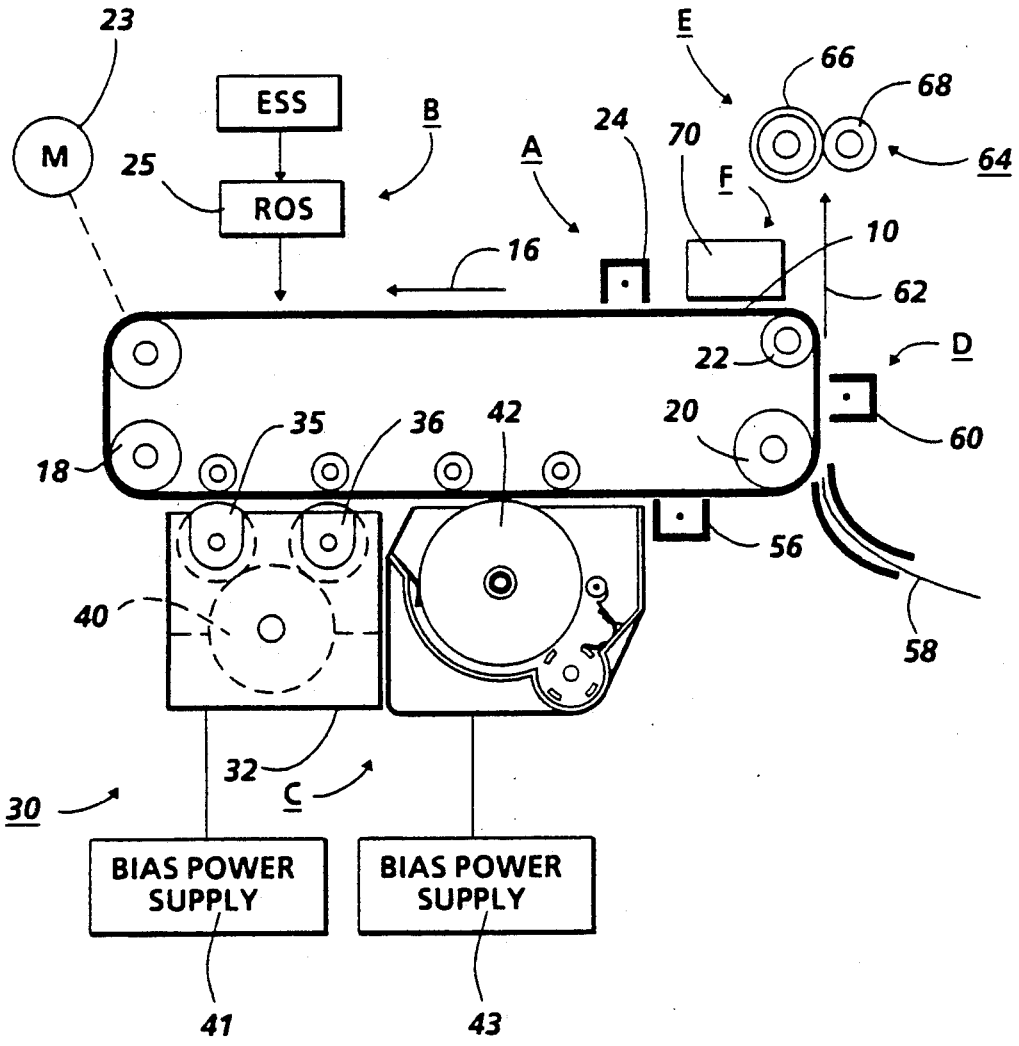
FIG. 2 is schematic illustration of a printing apparatus incorporating the inventive features of our invention.

As shown in FIG. 2, a printing machine incorporating the present invention may utilize a charge retentive member in the form of a photoconductive belt 10 consisting of a photoconductive surface and an electrically conductive substrate and mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 2, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, $V_0$. Preferably charging is negative. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based output scanning device 25 which causes the charge retentive surface to be discharged in accordance with the output from the scanning device. Preferably the scanning device is a three level laser Raster Output Scanner (ROS). Alternatively, the ROS could be replaced by a conventional xerographic exposure device.

The photoreceptor, which is initially charged to a voltage $V_0$, undergoes dark decay to a level $V_{ddp}$ equal to about 900 volts. When exposed at the exposure station B it is discharged to $V_c$ equal to about 100 volts which is near zero or ground potential in the highlight (i.e. color other than black) color parts of the image. See FIG. 1*a*. The photoreceptor is also discharged to $V_w$ equal to 500 volts imagewise in the background (white) image areas.

At development station C, a development system, indicated generally by the reference numeral 30 advances single component developer materials into contact with the electrostatic latent images. The development system 30 comprises first and second developer apparatuses 32 and 34. The developer apparatus 32 comprises a housing 34 containing a pair of magnetic brush rollers 35 and 36. The rollers advance developer material 40 into contact with the latent images on the charge retentive surface which are at the voltage level $V_c$. The developer material 40 by way of example comprises red toner. Appropriate electrical biasing is accomplished via power supply 41 electrically connected to developer apparatus 32. A DC bias of approximately 400 volts is applied to the rollers 36 and 38 via the power supply 41.

The developer apparatus 34 comprises a donor structure in the form of a rigid roller 42. The donor structure 42 conveys nonmagnetic single component developer or toner 44 deposited thereon and conditioned by a combination metering and charging device 46 (FIG. 3) to a position opposite an electrode structure. The device 46 is electrically biased using a DC power source 47. The developer in this case comprises black toner. The donor structure can be rotated in either the 'with' or 'against' direction vis-a-vis the direction of motion of the charge retentive surface. The donor roller 42 is preferably coated with TEFLON-S (trademark of E. I. duPont deNemours).

The developer apparatus further comprises an electrode structure 48 which is disposed in the space between the charge retentive surface 10 and the donor structure 42. The electrode structure comprises a plurality of thin (i.e. 50 to 100 $\mu$ diameter) tungsten wires which are closely positioned relative to the donor structure 42. The distance between the wires and the donor is approximately 25 $\mu$ or the diameter of a toner particle. The wires are self-spaced from the donor structure by the thickness of the toner on the donor structure. To this end the extremities of the wires are secured to the tops of end bearing blocks (not shown) supporting the donor structure for rotation. The extremities are attached so that they are slightly below a tangent to the surface, including the toner layer, of the donor structure. Mounting the wires in such a manner makes them insensitive to roll runout.

Figure 3:
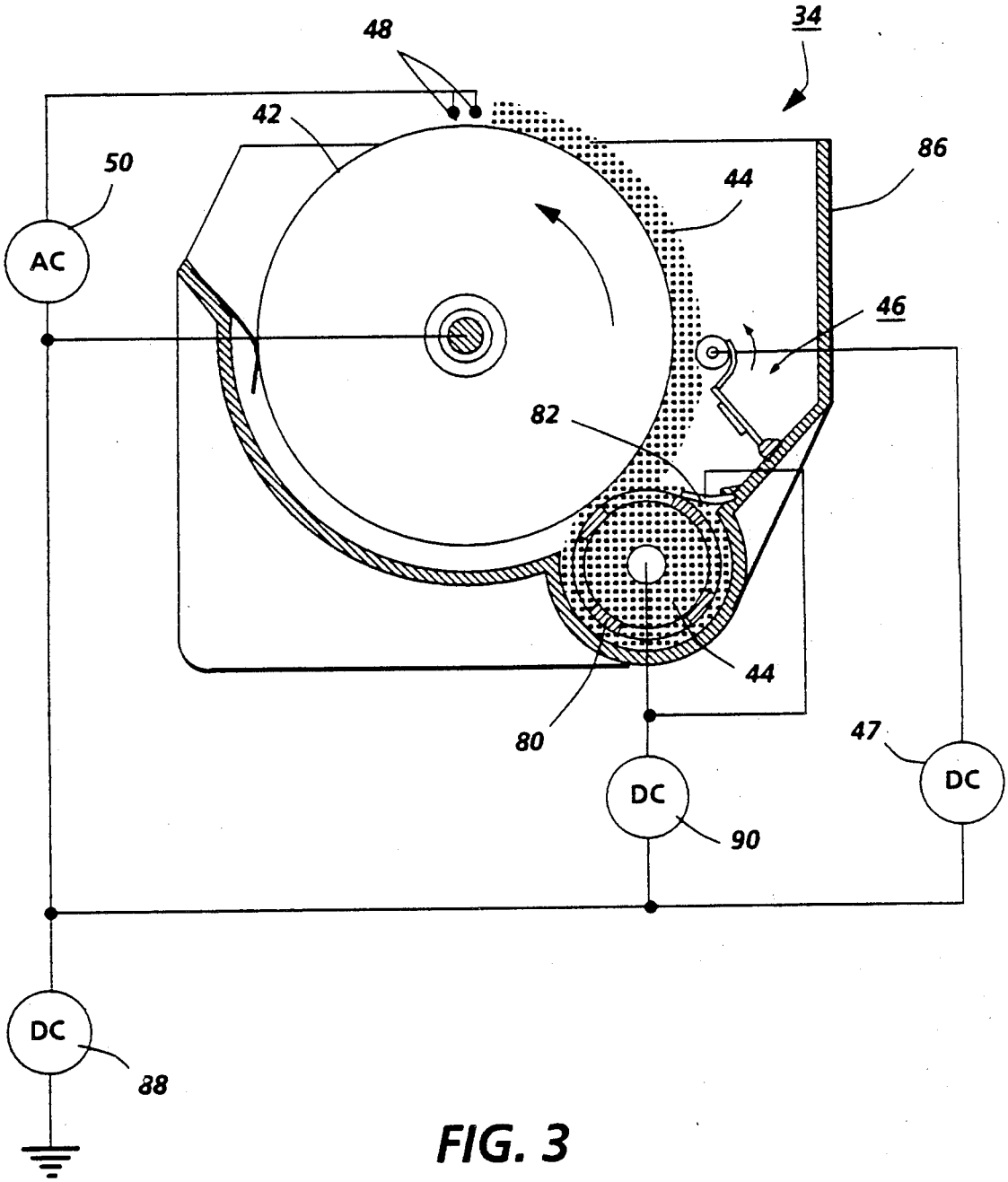
FIG. 3 is a fragmentary schematic illustration of a developer donor roll, donor reload member and electrical bias arrangement.

As illustrated in FIG. 3, an alternating electrical bias is applied to the electrode structure via an AC voltage source 50. The applied AC establishes an alternating electrostatic field between the wires and the donor structure which is effective to detach toner from the surface of the donor structure and form a toner cloud about the wires, the height of the cloud being such as not to contact with the charge retentive surface. The magnitude of the AC voltage is relatively low and is in the order of 200 to 300 volts peak at a frequency of about 4 kHz up to 10 kHz. A DC bias supply 88 which applies approximately 700 volts to the donor structure 42 establishes an electrostatic field between the charge retentive surface of the photoreceptor 10 and the donor structure for attracting the detached toner particles from the cloud surrounding the wires to the latent image on the charge retentive surface. At a spacing of approximately 25 $\mu$ between the electrode and donor structures an applied voltage of 200 to 300 volts produces a relatively large electrostatic field without risk of air breakdown. The field strength produced is in the order of 8 to 12 volts/$\mu$. While the AC bias is illustrated as being applied to the electrode structure it could equally as well be applied to the donor structure.

The donor structure 42, metering and charging device 46 together with a toner mover 80 and a reload flap 82 are operatively supported in a developer housing 86. The toner mover 80 serves to transport toner 44 from a remote supply of toner to an area in the housing opposite the donor structure 42 where it is transferred to the donor structure. The reload member is compliant to allow intimate rubbing contact with the surface of the toner mover. The member can be a flap of materials such as mylar, kapton, polyethylene, stainless steel, or brushes of materials such as nylon, stainless steel, carbon fiber. Other reload member configurations include a rotating cylindrical member such as a rod on the toner mover surface, a collection of beads which tumble on the toner mover surface or other compliant members for rubbing the surface of the toner mover.

The reload member 82 is supported in rubbing contact with the toner mover 80 for effecting reloading of the donor with toner 44 in a single revolution of the donor notwithstanding the presence of a high stress development condition such as the development of continuous solid areas.

The electrically biased toner mover and reload member are utilized in conjunction with the electrically biased donor roll 42 and the AC biased electrodes 48 disposed between the donor roll and the charge retentive surface. Toner clouding is effected by the AC biase electrodes and the electrostatic field established between the charge retentive surface and the donor roll causes toner forming the toner cloud to be deposited on the charge retentive surface in image configuration.

A sheet of support material 58 is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack copy sheets. Feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station D.

Because the composite image developed on the photoreceptor consists of both positive and negative toner, a positive pre-transfer corona discharge member 56 is provided to condition the toner for effective transfer to a substrate using negative corona discharge.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. The magnetic brush cleaner housing 9 is disposed at the cleaner station F. The cleaner apparatus comprises a conventional magnetic brush roll structure for causing carrier particles in the cleaner housing to form a brush like orientation relative to the roll structure and the charge retentive surface. It also includes a pair of detoning rolls for removing the residual toner from the brush.

Subsequent to cleaning a discharge lamp (not shown) floods the photoconductive surface with light to dissipate any residual electrostatic charge remaining prior to the charging thereof for the successive imaging cycle.

What is claimed is:

1. Apparatus for developing latent electrostatic images on a charge retentive surface with developer comprising toner, said apparatus comprising:

a donor structure for depositing toner on said charge retentive surface;

a toner mover supported for movement through a supply of toner to thereby stir up said toner;

means for establishing an electrostatic field between said donor structure and said toner mover for effecting toning of said donor structure with the stirred up toner;

means contacting said toner mover for enabling reloading of said donor roll structure in a single revolution thereof notwithstanding the presence of a high stress development condition.

2. Apparatus according to claim 1 wherein said means contacting said toner mover comprises means for preventing toner build-up on the surface of said toner mover.

3. Apparatus according to claim 3 wherein said means for preventing toner build-up comprises means for removing residual toner from the surface of said toner mover.

4. Apparatus according to claim 3 wherein said means for removing residual toner comprises a flap supported for wiping engagement with said toner mover.

5. Apparatus according to claim 4 wherein said flap is electrically conductive.

* * * * *